US006550889B2

(12) United States Patent
Colombat et al.

(10) Patent No.: US 6,550,889 B2
(45) Date of Patent: Apr. 22, 2003

(54) PROCESS AND DEVICE FOR CLEANING THE NOZZLES OF INKJET PRINTERS, AND PRINT HEAD AND PRINTER INCORPORATING SUCH A DEVICE

(75) Inventors: Thierry Colombat, La Voulte/Rhône (FR); Christophe Lopez, Bourg-les-Valences (FR)

(73) Assignee: Imaje S.A., Bourg les Valence (FR)

( * ) Notice: Subject to any disclaimer, the term of this patent is extended or adjusted under 35 U.S.C. 154(b) by 0 days.

(21) Appl. No.: 09/961,598

(22) Filed: Sep. 24, 2001

(65) Prior Publication Data

US 2002/0036670 A1 Mar. 28, 2002

(30) Foreign Application Priority Data

Sep. 26, 2000 (FR) ..... 00 12204

(51) Int. Cl.[7] ..... B41J 2/165
(52) U.S. Cl. ..... 347/28; 347/34
(58) Field of Search ..... 347/22, 28, 29–34, 347/35

(56) References Cited

U.S. PATENT DOCUMENTS 4,432,005 A * 2/1984 Duffield et al. ..... 347/28
4,959,662 A * 9/1990 Kobayashi ..... 347/28
5,664,938 A * 9/1997 Yang ..... 417/313

FOREIGN PATENT DOCUMENTS

| | | |
|---|---|---|
| DE | U- 87 14304 | 10/1987 |
| DE | U-89 08035 | 6/1989 |
| JP | 55050627 | 4/1980 |
| JP | 60033896 | 2/1985 |
| JP | 61232692 | 9/1986 |
| JP | 62175170 | 7/1987 |

* cited by examiner

*Primary Examiner*—Huan Tran
*Assistant Examiner*—An H. Do
(74) *Attorney, Agent, or Firm*—Pearne & Gordon LLP

(57) ABSTRACT

Process and device for cleaning the nozzles of ink jet printers, and the print head incorporating such a device.

A fixed cleaning jet (22) is installed on the print head, downstream of the ink nozzle to be cleaned (18) and offset to one side of it. When the ink jet stops, a given volume of solvent is sprayed by this cleaning jet, which hits the nozzle (18) at an angle. In this way the front face of the droplet generator is cleaned and scoured, and the ink residues are ejected towards the opposite side of the housing (36). Dry compressed air is then blown through the cleaning jet towards the ink nozzle (18) to dry the front of the nozzle and the ink residues deposited on the side of the housing (36).

15 Claims, 3 Drawing Sheets

PROCESS AND DEVICE FOR CLEANING THE NOZZLES OF INKJET PRINTERS, AND PRINT HEAD AND PRINTER INCORPORATING SUCH A DEVICE

DESCRIPTION

1. Technical Domain

The invention concerns a process for cleaning the ink nozzle or nozzles of an ink jet printer.

The invention also concerns a cleaning device using this process.

The invention also relates to a print head with one or more nozzles incorporating such a cleaning device, as well as printers comprising at least one such print head.

The invention can be used in all ink jet printers, whether of the continuous ink jet or "drop on demand" type.

2. State of Technology

As illustrated, in particular by document U.S. Pat. No. 3,373,437, in a continuous ink jet printer, a print head delivers at least one ink jet through a calibrating orifice supplied with ink under pressure. This ink supply comes from an ink reservoir that is either connected to a pump or pressurised by means of gas. Each jet is then broken down into droplets of ink, which are electrically charged by charging electrodes, in such a way that they are either deflected or not deflected by electrodes situated downstream. Depending on whether or not they are deflected, the droplets either will or will not be printed on a substrate situated downstream. At least one solenoid valve, situated within the supply line connecting the reservoir to the print head generally allows the flow of ink to be stopped when the printer is not running.

Printers that operate according to this technique may use inks incorporating volatile, very quick-drying solvents, or resins for ensuring good adhesion to difficult substrates, or even pigments in dispersion allowing opaque markings to be applied to dark substrates.

In "drop-on-demand" type printers, the ink droplets are released intermittently by a nozzle located in the wall of an ink chamber maintained at a less than atmospheric pressure. The chamber is supplied with ink from a reservoir under the simple effect of capillary forces. A piezo-electric or thermal transducer causes the droplets to be ejected by deforming the wall of the chamber.

In each of these two techniques;, the reliability of operation depends mainly on the conditions at the orifices, i.e., the state of the nozzles through which the ink is ejected.

These conditions are particularly difficult in "drop on demand" type printers, as the intermittent nature of their operation means that ink can remain standing in the nozzle for long periods of time. The inks used in printers of this type are thus very slow drying. Moreover, a large number of devices exist that are intended to avoid the ink drying on the nozzles and to guarantee that the consistency of the ink remains perfectly constant in the vicinity of the ejection orifice to ensure the proper ejection of droplets.

In continuous ink jet printers, it is easier to maintain the area immediately around the ink nozzle in clean condition when the jet is operating, as the bulk of the ink is then in movement and the risk of the ink drying is lower than in "droplet on demand" type printers.

On the other hand, with continuous ink jet printers, there is a very brief phase during the start-up of the jet that is particularly delicate. This is when the printer changes from a state where the ink is at rest in the reservoir to one in which a continuous high speed ink jet is established. Indeed, during this phase, the slightest obstruction to the flow of ink in the nozzle can significantly deflect its trajectory. This deflection may cause ink to come into contact with sensitive printer components situated downstream of the nozzle, such as the charging or deflecting electrodes, which are live.

The characteristics of the jet establishment phase in a continuous ink jet printer are very similar to those of the intermittent ejection of ink in a "droplet on demand" type printer. It is for this reason that the solutions initially developed for one of these two technologies are generally transferred to the other.

One of the most difficult problems to resolve in ink jet printers relates to the drying of the ink in the vicinity of the outside face of the nozzle when the jet is stopped. These residues may be caused by ink splashing during printing or simply by a projecting contact point of the meniscus formed by the ink inside the nozzle during operation or when the jet is stopped. This phenomenon is particularly critical in certain industrial applications using continuous ink jet printers, which use quick-drying, highly adhesive ink.

Many solutions have already been proposed for avoiding deflected jets at the start-up of continuous ink jet printers and/or to limit the consequences. However, none of these solutions gives entire satisfaction.

A solution that is known to limit the consequences of jet deflection at start-up consists in using retractable electrodes, that are placed out of reach of any jets that may be deflected during the start-up phases. This solution is relatively effective but is onerous to implement if the operator is required to manually move the electrodes. It is also expensive, due to the level of precision required for the alignment of the mobile electrodes.

The majority of known solutions seek rather to ensure start-up without deflected jets. These solutions can also be combined with those above.

A first known solution for avoiding deflection of jets start-up consists in cleaning the outer face of the nozzle by hand before each start-up, for example using a washing bottle, with or without mechanical brushing. This type of cleaning frequently requires subsequent drying of the surface of the nozzle using an air jet. Depending on the type of ink used, the damp residues may also be removed by mechanical scouring. This solution is particularly effective, but it is lengthy and not very ergonomic for the user, and its success is very dependant on the skill of the operator.

Another known solution for avoiding deflection of jets at start-up is described in document WO-A-91/00808. When the jet stops, a vacuum is created in the upstream chamber in order to avoid the expulsion of unwanted droplets of fluid in the vicinity of the ink meniscus as it is stabilising. The system is completed by a device for obstructing the orifice of the nozzle, situated on its upstream face. This solution avoids the ink from drying in the chamber and guarantees that the inside of the nozzle is clean, as the in the chamber is hermetically isolated from the outside air. This system does not guarantee the cleanliness of the outside face of the nozzle, however, which may have been wet by ink splashes during the start-up of the jet or during the printing phase.

Another known solution for avoiding deflection of jets at start-up is described in document U.S. Pat. No. 5,706,039. This solution consists in rinsing the nozzle from channels incorporated in the outer face of the nozzle plate.

This solution does not guarantee efficient or complete cleaning of the outside face of the nozzle, however, when the ink residues are highly adhesive. Moreover, it does not allow air drying. A certain amount of solvent therefore risks to remain around the nozzle, thus contributing to the deviation of the jet.

A fourth known solution for avoiding deflection of jets at start-up consists in totally immersing the print head housing in a solvent. This radical solution, which is described in document WO-A-99/01288, presents the problem of drying the elements of the print head that have been immersed. It also does not perform a mechanical action on the external face of the nozzle when this is required. Moreover, this solution leads to a high level of cleaning solvent consumption, which is neither cost effective or environmentally desirable on account of the large amount of liquid waste produced.

Document GB-A-2 316 364 describes an alternative version of the previous solution, in which a chamber of limited volume is attached to the charging electrode and placed in contact with the outer face of the nozzle. The chamber can be in turn filled with cleaning solvent or emptied of solvent residue by suction. This solution significantly reduces the volumes of liquid used. It does, however, have the same shortcomings of the previous solution regarding the absence of mechanical action and drying.

A further known solution for avoiding deflection of jets at the start-up of continuous ink jet printers is described in document WO-A-86/06026. In this case, an external, retractable nozzle cleaning accessory is mounted on the outer face of the nozzle. This solution is costly and difficult to implement, due to the additional apparatus it requires. Moreover, cleaning consists simply of immersing the nozzle, which is frequently insufficient when highly adhesive ink is used. Solvent consumption and the volume of waste also remain high.

As described in particular in document EP-A-0 437 361, another known solution consists in wiping and scraping the outer surface of the nozzle using thin, flexible blade suited to this purpose. However, the choice of material for the scraping blade is difficult for printers using solvent inks. Moreover, this solution requires a cumbersome device for controlling the relative movement of the nozzle and the scraper.

All of the previous solutions can be used with nozzle plates whose surfaces have been treated to reduce their wettability and minimise ink adhesion, as described in document FR-A-2 747 960.

A final known solution consists of systematically sealing the end face of the nozzle when the jet stops, by means of a contact valve as explained in document EP-A-0 017 669. The effectiveness of this solution is uncertain when using quick drying inks, however, and it does not guarantee that the cleanliness of the external face of the nozzle when the valve opens.

In conclusion, none of the known solutions to date can perform all of the essential operations necessary for ensuring the proper operation and total reliability of the print head after the jet has stopped, in a simple and inexpensive manner, regardless of the type of ink used.

DISCLOSURE OF THE INVENTION

The specific object of the invention is a nozzle cleaning process performing all of the operations necessary for the proper operation and total reliability of the print head in a simple and inexpensive manner, using no moving or retractable elements, using a small volume of solvent, generating small amounts of waste, in a manner adapted to the characteristics of the ink, as required, in other words, spaying the external face of the nozzle with solvent, while simultaneously performing local mechanical action, scraping off residues and removing them from the area around the nozzle, and perfectly drying and removing all traces of solvent after cleaning.

According to the invention, this result is achieved by a process for cleaning at least one ink nozzle of an ink jet printer after the jet has stopped, said process being characterised by the fact that it comprises the following successive stages:

- the spraying of cleaning solvent towards the ink nozzle, at an angle to the ink jet, from a fixed cleaning jet situated downstream of the nozzle.
- the blowing of dry air towards the front face of the ink nozzle from said cleaning jet.

In the process thus defined, the solvent leaving the cleaning jet is sprayed onto the nozzle in a cone of fine droplets ejected at high speed. The micro-droplets hit the area around the nozzle to be cleaned. The mechanical impact of the droplets and the subsequent streaming of the solvent on the front face of the nozzle plate result in effective cleaning. The angle of inclination of the solvent spray relative to the front face of the nozzle allows the ink residue to be scraped off and removed away from the immediate vicinity of the nozzle by friction. The waste ink is projected against the inside face of the print head housing, in an area remote from the electrodes.

The wetting of the nozzle with solvent, the simultaneous local mechanical action, the scraping of residue and its removal well away from the nozzle area are thus ensured simply and inexpensively when the solvent is sprayed by the cleaning jet.

The dry air that is then blown by the cleaning jet also allows the area around the ink nozzle to be dried and the ink residue to be deposited on the inside of the housing.

According to a preferred embodiment of the invention, the orifice of the cleaning jet used has a diameter of between five and fifteen times that of the ink nozzle.

Moreover, the cleaning jet is best positioned downstream of the ink nozzle, and at distance of between five and fifteen times the diameter of the cleaning jet.

The volume and pressure of the solvent and air supplied to the cleaning jet are preferably adjusted to suit the nature of the ink used in the printer.

In the preferred embodiment of the invention, the cleaning jet is supplied with cleaning solvent at a pressure in excess of 100 mbars.

It is best to control the supply of solvent and air to the cleaning jet by means of two solenoid valves or one three-way solenoid valve.

The printer will preferably be provided with a porous surface to recover the residues resulting from cleaning, said surface to be situated downstream of the ink nozzle and opposite the cleaning jet relative to the ink nozzle.

The invention also concerns a device for cleaning at least one ink nozzle of an ink jet when the jet is stopped, said device being characterised by the fact that it comprises a fixed cleaning jet located downstream from the ink nozzle and able to spray cleaning solvent, then blow dry air towards the ink nozzle, at an angle to the ink jet, when the device is operated.

The invention also relates to a print head containing at least one ink nozzle and a device for cleaning same, in the embodiment just defined.

The invention also concerns a printer containing at least one such print head.

BRIEF DESCRIPTION OF DRAWINGS

We will now describe, by way of a non-limitative example, a preferred embodiment of the invention by referring to the ended drawings, in which.

DETAILED DESCRIPTION OF THE PREFERRED EMBODIMENT OF THE INVENTION

Figure 1:
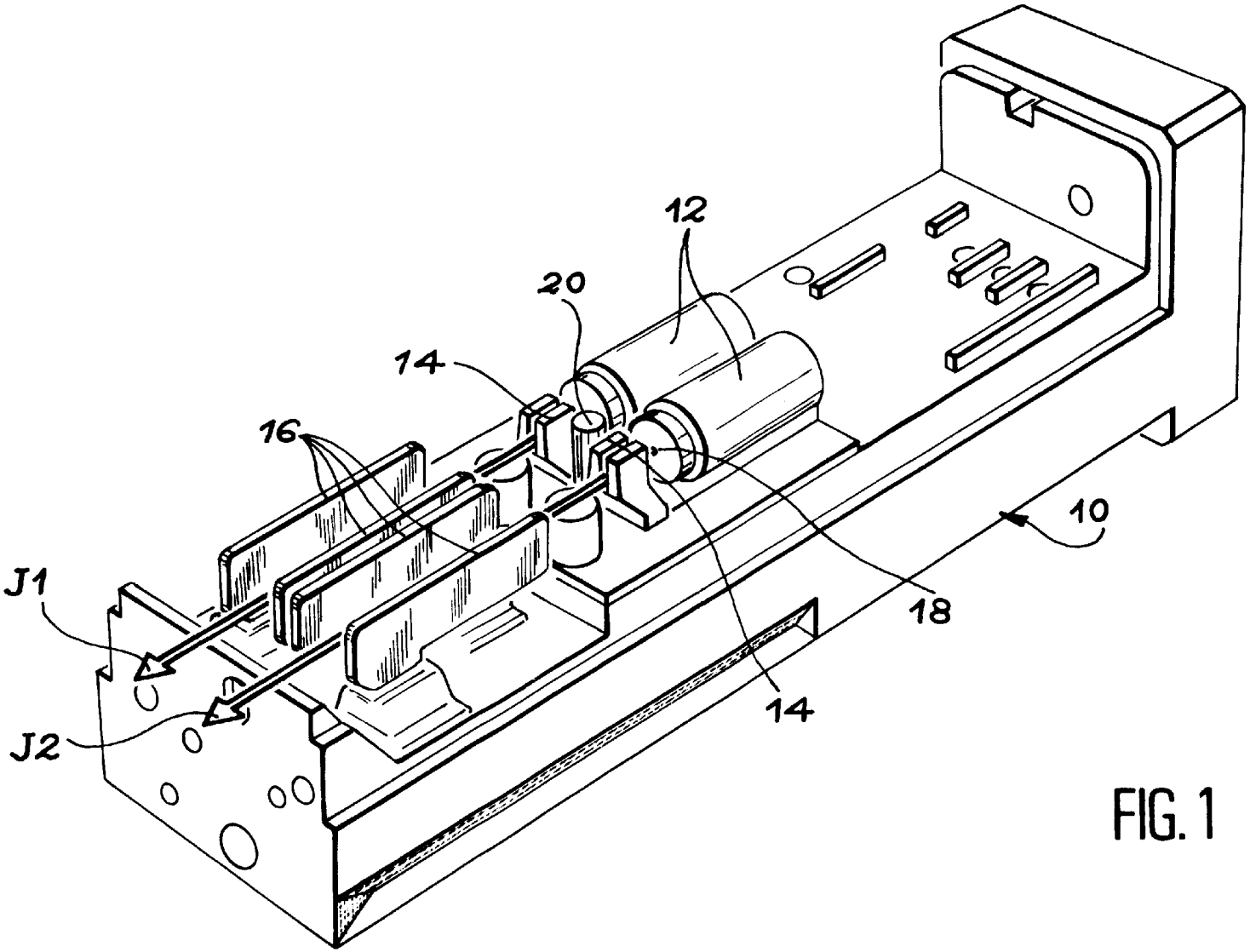
FIG. 1 is a perspective view showing a print head fitted with a cleaning device according to the invention.

In FIG. 1, we have shown in diagrammatic form, by way of a non-limitative example, a print head with two ink jets incorporating a cleaning device according to the invention.

As will be easily understood, the invention is not limited to print heads with two jets, but also relates single jet print heads as well as those with three or more jets.

According to an arrangement that is well known to specialists in the field, one or more print heads are normally connected to the same ink reservoir to form an ink jet printer.

Figure 2:
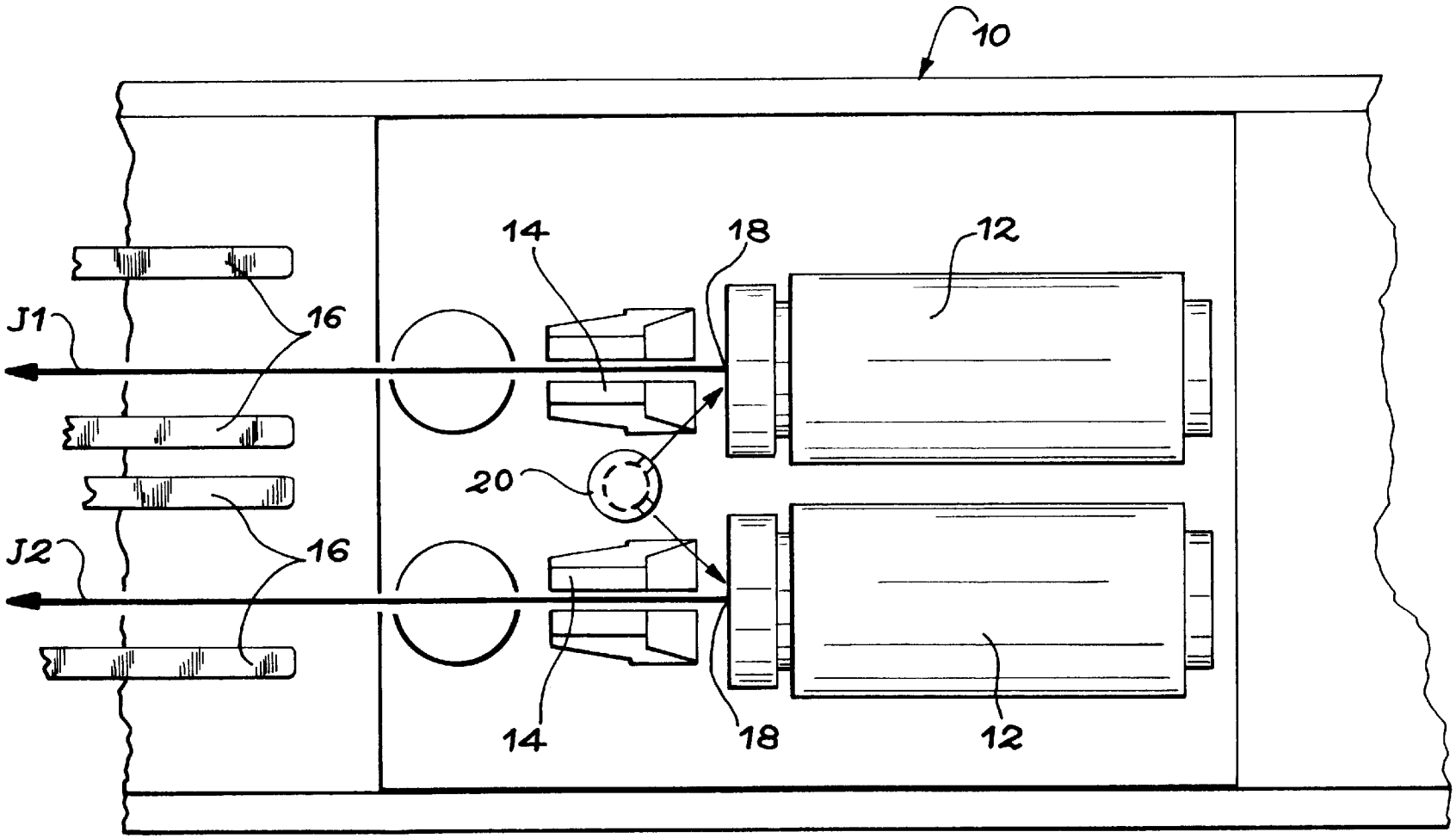
FIG. 2 is a larger scale view from above of the part of the print head of FIG. 1 containing the ink nozzle and cleaning jet of the cleaning device.

The print head shown in FIGS. 1 and 2 is of the continuous ink jet type. Nevertheless, for the reasons given earlier, the cleaning device according to the invention can also be used in "droplet on demand" type print heads, while remaining within the context of the invention.

In a well-known manner, the print head illustrated in FIG. 1 consists of a housing 10 which supports one droplet generator 12, one charging electrode 14 surrounding the jet, and two deflecting electrodes 16 for each for each jet resembling J1 and J2.

Each of the droplet generators 12 delivers a jet of ink broken down into fine droplets from an ink nozzle 18 in a controlled manner. More specifically, each of the jets resembling J1 and J2 is delivered along the axis of the nozzle 18, in such a way that the directions of the jets are essentially parallel to one another in the case of print heads with more than one jet.

A charging electrode 14 is located downstream of each jet 12, at the point at which the jet separates into droplets, which forms an aperture around the trajectory of the corresponding jet. It is controlled in a known manner, in order to charge the ink droplets, or leave them uncharged, according to what is to be printed.

The deflecting electrodes 16 are themselves situated downstream of the charging electrode 14, to either side of the trajectory of the jet. They serve, also in a known manner, to deviate the trajectories of the droplets or leave them unchanged, according to the electrical field created by their different voltages. The droplets of each of the jets resembling J1 and J2 thus follow a trajectory that will depend on the electrical charge given to them by the charging electrode 14. This technology permits the desired motifs to be printed on a given substrate situated downstream of the deflecting electrodes 16. It is well known to specialists in the field, and so will not be described in detail.

In accordance with the invention, the print head illustrated in FIG. 1 includes a device for cleaning the ink nozzles 18. This device comprises in particular an injector 20, which can be more clearly seen in FIGS. 2 and 3.

In the embodiment shown, which concerns a print head with two jets, the injector is provided with two cleaning jets 22, each directed at one of the ink nozzles 18. Where the print head delivers a single ink jet, the injector 20 will have only one cleaning jet 22. It is for this reason that one of the cleaning jets and the corresponding ink nozzle have been indicated with a chain-dotted line in FIG. 3.

The injector 20 is installed in the print head housing 10, in a fixed location. This location is slightly downstream of the front face 19 of the nozzle plate in which the nozzle 18 is formed. This location is also offset laterally relative to the jets resembling J1 and J2 and the charging electrodes 14, as shown in particular in FIGS. 1 and 2.

More specifically, in the embodiment shown, in which the print head emits two ink jets that are essentially parallel to one another, the injector 20 is positioned between the charging electrodes assigned to each ink jet, and equidistant from each.

The injector 20 is a tubular element with its (generally vertical) axis orthogonal to the (generally horizontal) direction of emission of the jets resembling J1 and J2 at the outlet of the ink nozzle 18. This tubular element is open at its bottom end and closed at the top.

Figure 3:
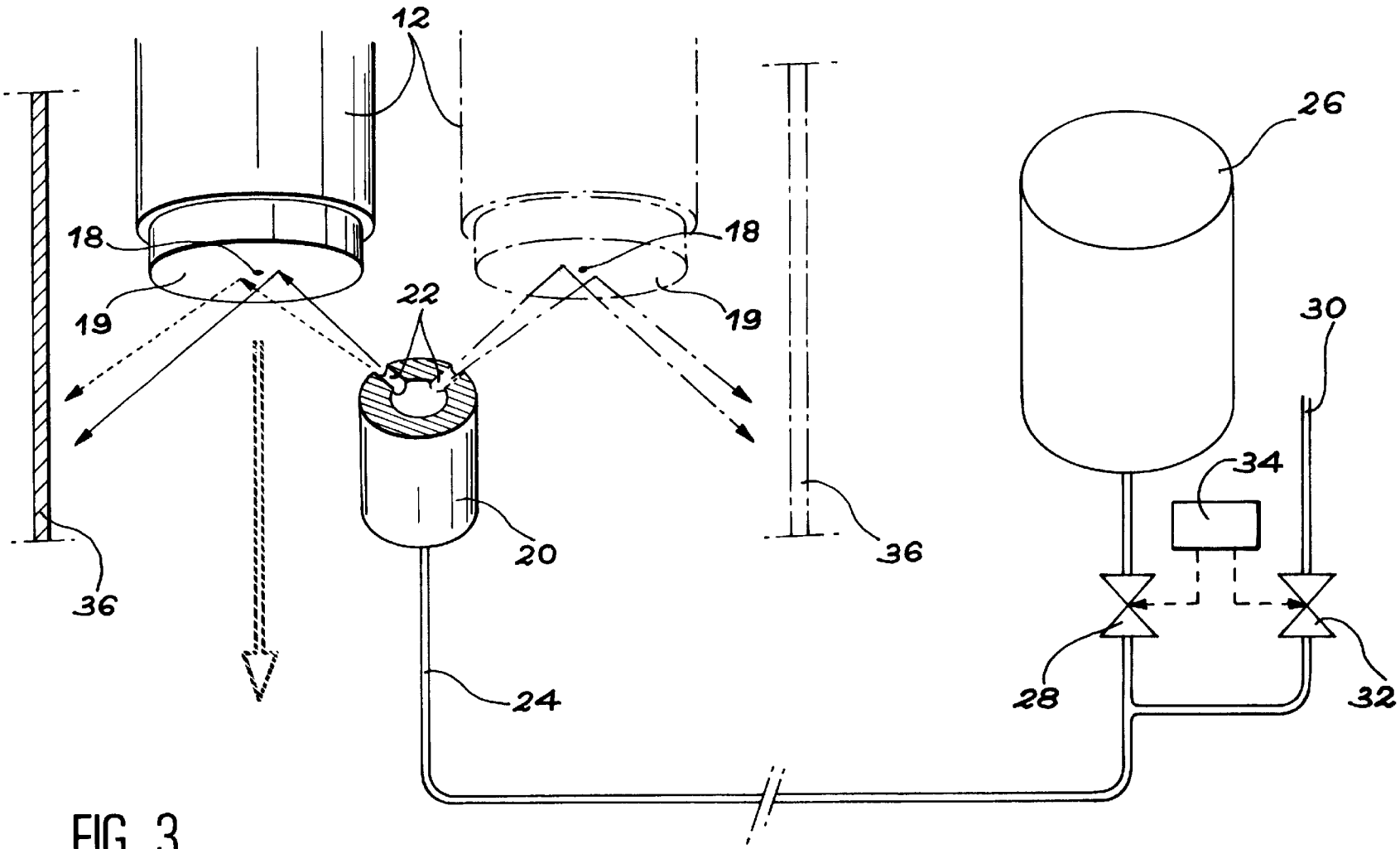
FIG. 3 is a diagrammatic representation of the cleaning device and the ink nozzles adjacent to the cleaning jet.

The cleaning jets 22 are generally circular holes through the wall of the injector are situated more or less in the plane of the trajectory of jets J1 and J2. Each of the cleaning jets 22 is directed towards one of the ink nozzles 18, as shown in FIGS. 2 and 3. Because the injector 20 is offset laterally relative to the two ink jets, the spray from the cleaning jets 22 is thus directed at an angle to the ink jets.

The relative positioning of the cleaning jets 22 and the ink nozzles 18 will preferably be such that the cleaning jets 22 are set downstream of the ink nozzles 18, symmetrically to the ink jets at a distance of between five and fifteen times the diameter of the cleaning jets 22.

Although not essential, it is also best to set the diameter of the cleaning jets 22 at a value between five and fifteen times the diameter of the ink nozzles 18 (for the sake of clarity, this characteristic has not been respected in FIG. 3). A particularly advantageous compromise consists in using cleaning jets 22 having a diameter equal to ten times that of the ink nozzles 18. Thus, by way of example only, cleaning jets of 0.5 mm diameter can be used with ink nozzles of 50 microns diameter.

As shown diagrammatically in FIG. 3, the lower, open end of the tubular element forming the injector 20 is connected by means of a leak tight connection to the outlet end of a supply line 24 (the sizes shown in the diagram are not actual sizes). The inlet end of the supply line 24 is connected to a solvent reservoir 26 via a first solenoid valve 28. The supply line 24 has a small internal diameter, e.g.: 1 mm.

The solvent reservoir 26 may be either closed (such as a solvent cartridge) or open to the atmosphere.

A branch line 30 is connected to the supply line 24 just downstream of the first solenoid valve. The other end of the branch line 30 is connected to a compressed air supply via a second solenoid valve 32. The compressed air system will preferably supply compressed air at a pressure of more than 3 bars.

A programmable central control unit 34 is electronically connected to the solenoid valves 28 and 32, in order to ensure their operation. Alternatively, the two-way solenoid valves 28 and 32 can be replaced by a single three-way solenoid valve. As will be better understood later, this central control unit 34 serves in particular to adjust the volume and pressures of solvent and air supplied to the cleaning jets 22, according to the nature and characteristics of the ink used in the printer.

The components of the cleaning device according to the invention, with the exception of the injector 20, are located in the printer's ink circuit (not shown).

The principal of operation of the ink nozzle cleaning device according to the invention will now be explained by referring in particular to FIG. 3.

The device is generally operated before the starting-up of the ink jet. It can also be operated after the jet has stopped, according to the envisaged stoppage time and the type of ink used in the printer.

A first phase of the cleaning cycle involves filling a section of the supply line 24 situated downstream of the first solenoid valve 28 with solvent.

In the embodiment shown, where the solvent reservoir is a closed cartridge, it is first of all slightly pressurised. In order to achieve this, the second solenoid valve 32 is kept continuously open, there being no solvent in supply line 24. In addition, the first solenoid valve 28 is opened intermittently, according to a programmed sequence. In this way, the solvent cartridge is slightly pressurised.

The first phase continues with the delivery of a programmed volume of solvent to a section of the supply line 24 situated downstream of the first solenoid valve 28. In order to achieve this, the first solenoid valve 28 is opened for a programmed period of time. This period of time, which will depend on the type of ink used and the characteristics of the sprayer 20, is generally a matter of seconds. By way of a non-limitative example, a volume of solvent of approximately 0.1 $cm^3$ can be delivered to a 100 mm long 1 mm diameter section of supply line 24. Upon completion of this first phase, the solenoid valves 28 and 32 are closed.

In the case of a printer with a solvent reservoir at atmospheric pressure, the supply line is filled by gravity. The total washing cycle will then last a little longer.

A second phase of the cleaning cycle consists in displacing solvent in the supply line 24, up to the sprayer 20.

This second phase is triggered by the opening of the second solenoid valve 32. The volume of solvent then situated in a section of the supply line 24 adjoining the first solenoid valve 28 is immediately pushed by the compressed air to the sprayer 20. The small diameter of the supply line 24 allows a relatively even flow of solvent to be ensured, despite the fact that it is mixed with air bubbles. The solvent is displaced in the supply line 24 at approximately 0.5 m/s, for as long as the air located downstream is ejected from the cleaning jets 22. By way of a non-limitative example, in the case of a supply line 24 approximately 10 meters long, this will last approximately 20 seconds.

The cleaning of the ink nozzles 18 constitutes a third phase of the operating cycle of the device according to the invention. This third phase follows on seamlessly from the second phase in which the solvent is displaced in the supply line 24.

When the mixture of solvent and air reaches the cleaning jets 22, the speed of ejection from the orifices is of the order of 20 m/s. This causes the solvent to be ejected in a high speed, cone-shaped spray of fine droplets. Because the cleaning jets 22 are directed at the ink nozzles 18, the micro-droplets hit the areas around each of the ink nozzles to be cleaned.

The mechanical impact of the droplets and the subsequent streaming of the fluid on the front face of the nozzle plate properly cleans the nozzles, regardless of the type of ink used. Because the jet sprayed by each of the cleaning jets 22 is directed at an angle to the axis of the corresponding ink nozzle 18, the front face of the ink nozzle is scoured by the jet and the waste ink is removed from the immediate vicinity of the ink nozzle by friction.

More specifically, the ink residues are projected towards the inside surface of the side walls 36 (FIG. 3) of the print head housing 10 on the opposite side of the ink nozzle 18 from the cleaning jets 22. The ink residues are thus removed to an area very remote from the electrodes 14 and 16. It is best if the inside surfaces of the side walls 36 take the form of porous surfaces to recover the cleaning residue, at least downstream of the ink nozzles 18.

By way of a non limitative illustration of the invention, the solvent-air mixture spraying phase lasts approximately 10 seconds. It is important to note, however, that the duration of this phase depends on the type of ink used in the printer.

A fourth and final phase of the operation of the cleaning device according to the invention consists of a drying operation, which follows on seamlessly from the nozzle cleaning phase.

When all of the solvent initially fed into the supply line 24 has been sprayed on the ink nozzles 18, the second solenoid valve 32 remains open during a programmed length of time. Consequently, dry compressed air is blown onto the ink nozzles. This allows the area around each of the ink nozzles 18 to be dried, as well as the waste projected onto the inside face of each of the side walls 36 of the housing 10.

The cycle ends with the closing of the second solenoid valve 32. The supply line 24 will then be empty of solvent once more and another washing cycle can begin if necessary.

By way of a non limitative illustration of the invention, the whole of the cycle just described lasts approximately 40 seconds.

The above description shows that the cleaning cycle is operated by opening and closing the solenoid valves 28 and 32 in a programmed sequence. These sequences are controlled by the programmable central control unit, using an appropriate program. This program takes account in particular of the nature and characteristics of the ink used in the printer. It thus allows the volume and pressure of solvent and air supplied to the cleaning jets 22 to be adjusted to suit the type of ink used. This, in particular, allows fluid use to be optimised and avoids unnecessary waste.

The above description shows that the process and the device according to the invention together perform all of the essential operations for the proper operation and total reliability of a print head at a much lower cost than that of the retractable or motor-driven devices according to the prior art.

Obviously, the invention is not limited to the embodiment described by way of example. Thus, instead of being attached independently of one another on the housing 10, the sprayer 20 and the charging electrode 14 could also be mounted on a common supporting component that is then attached to the housing 10.

What is claimed is:

1. A process of cleaning at least one ink nozzle of an ink jet printer when a jet is stopped, said process comprising the following successive steps:

spraying a cleaning solvent towards the ink nozzle, at an angle to the ink jet, from an immovably fixed cleaning jet always situated downstream of the nozzle wherein the nozzle is immovably fixed relative to the cleaning jet; and blowing dry air towards the front face of the ink nozzle from said cleaning jet.

2. Process according to claim 1, in which is used a cleaning jet with an orifice having a diameter of between five and fifteen times that of the ink nozzle.

3. Process according to claim 1, in which the cleaning jet is placed downstream of the ink nozzle, at a distance of between five and fifteen times the diameter of the cleaning jet.

4. Process according to claim 1, in which the volume and pressure of the solvent and air supplied to the cleaning jet are adjusted according to the nature of the ink used in the printer.

5. Process according to claim 1, in which solvent is supplied to the cleaning jet at a pressure of more than 100 mbars.

6. Process according to claim 1, in which the supply of solvent and air to the cleaning jet is controlled by means of two solenoid valves or one three-way solenoid valve.

7. Process according to claim 1, in which the printer is provided with a porous surface for the recovery of cleaning residues, situated downstream of the ink nozzle and opposite the cleaning jet relative to the nozzle.

8. A device for cleaning at least one ink nozzle of an ink jet printer when a jet is stopped, said device comprising an immovably fixed cleaning jet always situated downstream of the ink nozzle and able to spray cleaning solvent and then blow dry air towards the ink nozzle, at an angle to the ink jet, when the device is operated, wherein the ink nozzle is immovably fixed relative to the cleaning jet.

9. Device according to claim 8, in which the cleaning jet comprises an orifice having a diameter of between five and fifteen times that of the ink nozzle.

10. Device according to claim 8, in which the cleaning jet is placed downstream of the ink nozzle, at a distance of between five and fifteen times the diameter of the cleaning jet.

11. Device according to claim 8, in which the cleaning jet is located at the end of a supply line that is able to be connected to a solvent reservoir via a first solenoid valve and to a compressed air circuit via a second solenoid valve, or by a three-way solenoid valve.

12. Device according to claim 11, in which the solenoid valves are connected to a programmable central control unit, that is able to adjust the volume and pressure of the solvent and air supplied to the cleaning jet according to the nature of the ink used in the printer.

13. Device according to claim 8, in which a porous surface is provided downstream of the ink nozzle and opposite the cleaning jet relative to the ink nozzle, for the purpose of recovering the cleaning residue.

14. A print head comprising at least one immovably fixed ink nozzle and a device for cleaning said nozzle, said device comprising an immovably fixed cleaning jet always located downstream of the ink nozzle and able to spray cleaning solvent then blow dry air towards the ink nozzle, at an angle to the ink jet, when the device is operated.

15. A printer comprising at least one print head having at least one immovably fixed ink nozzle and a device for cleaning said nozzle, said device comprising an immovably fixed cleaning jet always located downstream of the ink nozzle and able to spray cleaning solvent then blow dry air towards the ink nozzle, at an angle to the ink jet, when the device is operated.

* * * * *